US011189436B2

(12) United States Patent
Chien

(10) Patent No.: US 11,189,436 B2
(45) Date of Patent: Nov. 30, 2021

(54) SCISSOR-TYPE CONNECTING ASSEMBLY OF KEY STRUCTURE

(71) Applicant: Chicony Electronics Co., Ltd., New Taipei (TW)

(72) Inventor: Jun-Way Chien, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 16/673,790

(22) Filed: Nov. 4, 2019

(65) Prior Publication Data

US 2020/0365341 A1 Nov. 19, 2020

(30) Foreign Application Priority Data

May 13, 2019 (TW) ..... 108116477

(51) Int. Cl.
*H01H 3/12* (2006.01)
*H01H 13/705* (2006.01)

(52) U.S. Cl.
CPC ..... *H01H 3/125* (2013.01); *H01H 13/705* (2013.01)

(58) Field of Classification Search
CPC ..... H01H 3/125; H01H 13/705; H01H 13/20; H01H 2221/03; H01H 2221/064; H01H 13/70; H01H 33/00; H01H 3/04; H01H 3/02; H01H 3/12; H01H 2003/00; H01H 2003/12; H01H 2019/036; H01H 2233/07; H01H 2237/004; H01H 2239/056
USPC ..... 200/341
See application file for complete search history.

(56) References Cited

U.S. PATENT DOCUMENTS 6,504,121 B2 * 1/2003 Hasunuma ..... H01H 3/125 200/344
6,706,986 B2 * 3/2004 Hsu ..... H01H 3/125 200/344
6,733,196 B2 * 5/2004 Lee ..... H01H 3/125 200/344
6,906,272 B1 * 6/2005 Tsai ..... H01H 3/125 200/344
7,385,149 B2 * 6/2008 Liu ..... H01H 3/125 200/341
7,893,376 B2 * 2/2011 Chen ..... H01H 3/125 200/344
8,642,904 B2 * 2/2014 Chiba ..... H01H 13/7065 200/344
8,829,377 B2 * 9/2014 Khor ..... H01H 3/125 200/344

FOREIGN PATENT DOCUMENTS

TW 201907427 A 2/2019

* cited by examiner

*Primary Examiner* — Edwin A. Leon
(74) *Attorney, Agent, or Firm* — Muncy, Geissler, Olds & Lowe, P.C.

(57) ABSTRACT

A key structure includes a keycap, a base plate and a scissor-type connecting assembly. The scissor-type connecting assembly includes a first connecting member and a second connecting member. One end of the first connecting member connects to the base plate, and the other end connects to the keycap. The first connecting member includes at least one pivot having a convex portion. One end of the second connecting member connects to the base plate, and the other end connects to the keycap. The second connecting member comprises at least one pivot hole, and the pivot is disposed in the pivot hole.

9 Claims, 5 Drawing Sheets

SCISSOR-TYPE CONNECTING ASSEMBLY OF KEY STRUCTURE

BACKGROUND

1. Technical Field

The present disclosure relates to a key structure.

2. Description of the Related Art

A keyboard is commonly used in conjunction with a computer as one of the essential input devices. Generally, when most computers and peripheral devices used with computers are developed, lighter, thinner, shorter, and more compact designs are often preferred or required. Keyboards have also been occupying smaller volumes over time. Earlier keyboards were relatively large, while slim keyboards are very common today.

In a general keyboard, a keycap of a key structure is returned to the original position by an elastic element. FIG. 1 is a schematic diagram of a conventional scissor-type connecting member. Referring to FIG. 1, the conventional scissor-type connecting member 9 includes an inner connecting member 91 and an outer connecting member 92. One end of the inner connecting member 91 and the outer connecting member 92 connect to a base plate, the other end of the inner connecting member 91 and the outer connecting member 92 connect to a keycap (not show in FIG. 1), and the inner connecting member 91 and the outer connecting member 92 are connected to each other by a pivot and a pivot hole. Specifically, the inner connecting member 91 has a pivot 911, and the outer connecting member 92 has a pivot hole 921. If the pivot 911 and the pivot hole 921 interfere with each other after being combined, the keycap cannot smoothly move up and down. Therefore, the size of the pivot 911 is usually designed to have negative tolerance, and the size of the pivot hole 921 is designed to have positive tolerance.

Further, for easy combination, an upper limit value of the tolerance range is usually taken as the negative tolerance of the pivot 911, and a lower limit value of the tolerance range is taken as the positive tolerance of the pivot hole 921. However, this design would cause a space S to be formed between the pivot 911 and pivot hole 921, and thereby the user would feel obvious shaking when pressing the keycap. Further, the asymmetric scissor-type connecting member can easily cause keycap tilting.

SUMMARY

In view of the above problems, the main object of the present disclosure is to provide a key structure, wherein the novel structure of the (a first and a second) connecting member solves the problem of the conventional key structure easily shaking.

In order to achieve the above object, the present disclosure provides a key structure, which comprises a keycap, a base plate and a scissor-type connecting assembly. The scissor-type connecting assembly comprises a first connecting member and a second connecting member. One end of the first connecting member connects to the base plate, and the other end connects to the keycap. The first connecting member comprises at least one pivot having a convex portion. One end of the second connecting member connects to the base plate, and the other end connects to the keycap.

The second connecting member comprises at least one pivot hole, and the pivot is disposed in the pivot hole.

According to an embodiment of the present disclosure, a maximum inner diameter of the pivot hole is greater than a maximum outer diameter of the pivot.

According to an embodiment of the present disclosure, a minimum inner diameter of the pivot hole is smaller than or equal to a maximum outer diameter of the pivot.

According to an embodiment of the present disclosure, the pivot hole comprises a recess located on an inner wall of the pivot hole.

According to an embodiment of the present disclosure, the convex portion is corresponded to the recess, such that the pivot is assembled in the pivot hole.

According to an embodiment of the present disclosure, the convex portion presses against the inner wall of the pivot hole when the keycap is pressed down.

According to an embodiment of the present disclosure, a position of the convex portion pressing against the pivot hole is adjacent to the recess.

According to an embodiment of the present disclosure, the pivot of the first connecting member is a camshaft.

According to an embodiment of the present disclosure, the first connecting member is located inside the second connecting member.

As described above, according to the key structure of the present disclosure, the scissor-type connecting assembly includes a first connecting member and a second connecting member. The first connecting member includes at least one pivot having the convex portion. The second connecting member includes at least one pivot hole, and the pivot is disposed in the pivot hole. The space between the pivot and the pivot hole can be reduced by the structure of the convex portion such that shaking of the keycap when the keycap is pressed can also be reduced.

DETAILED DESCRIPTION OF THE EMBODIMENTS

In order to make the structure and characteristics as well as the effectiveness of the present disclosure further understood and recognized, a detailed description of the present disclosure is provided as follows, along with embodiments and accompanying figures.

Figure 1:
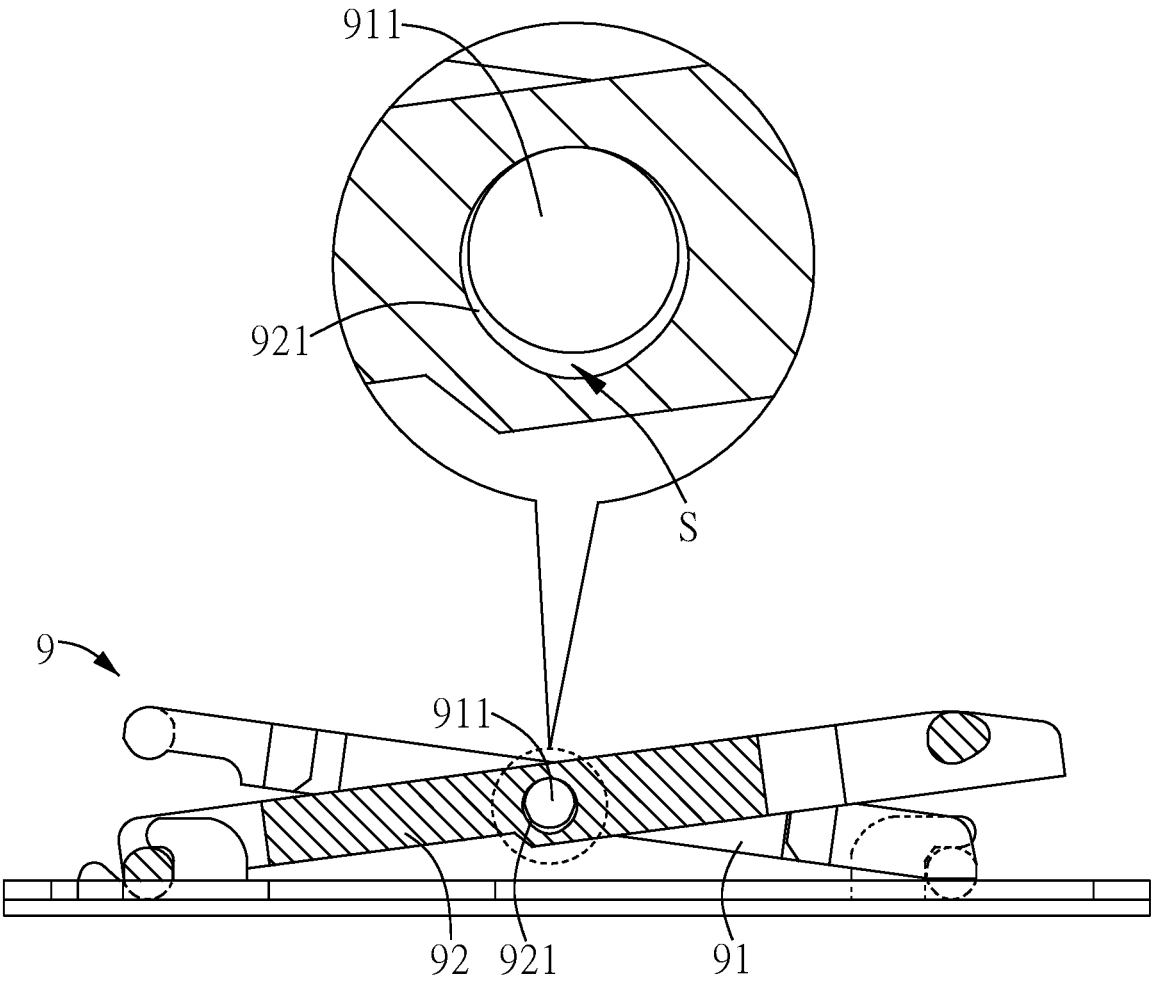
FIG. 1 (Prior Art)
FIG. 1 is a schematic diagram of a conventional scissor-type connecting member.
Figure 2:
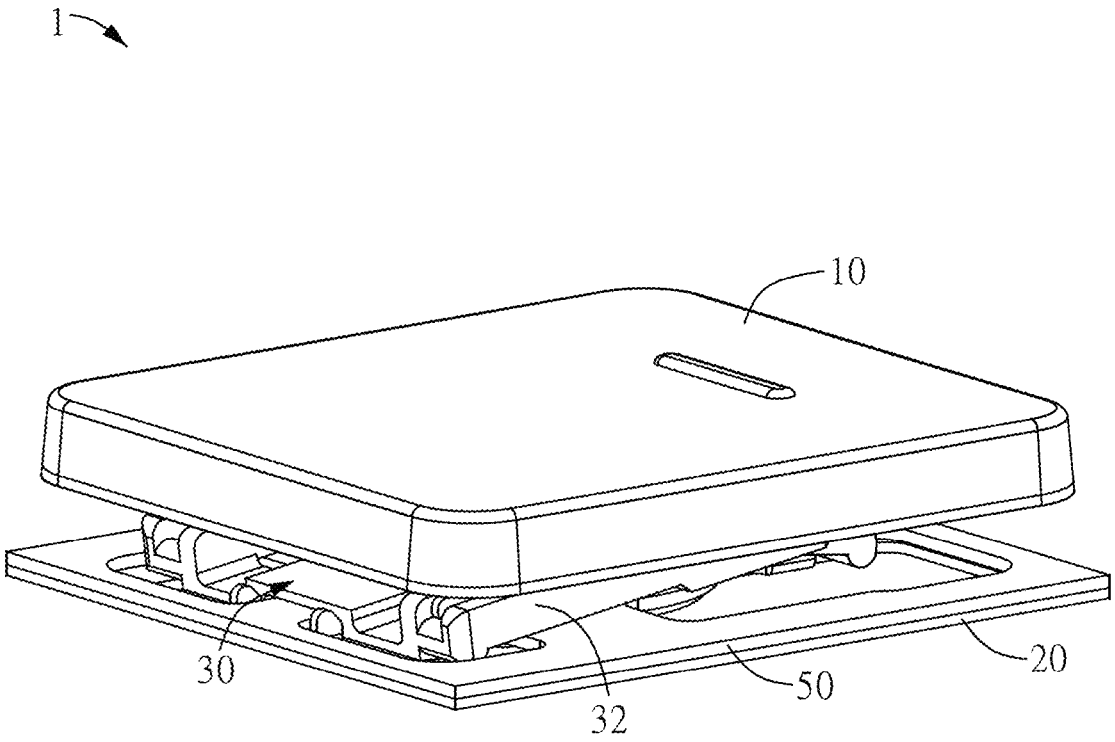
FIG. 2 illustrates a schematic view of a key structure according to an embodiment of the present disclosure.
Figure 3:
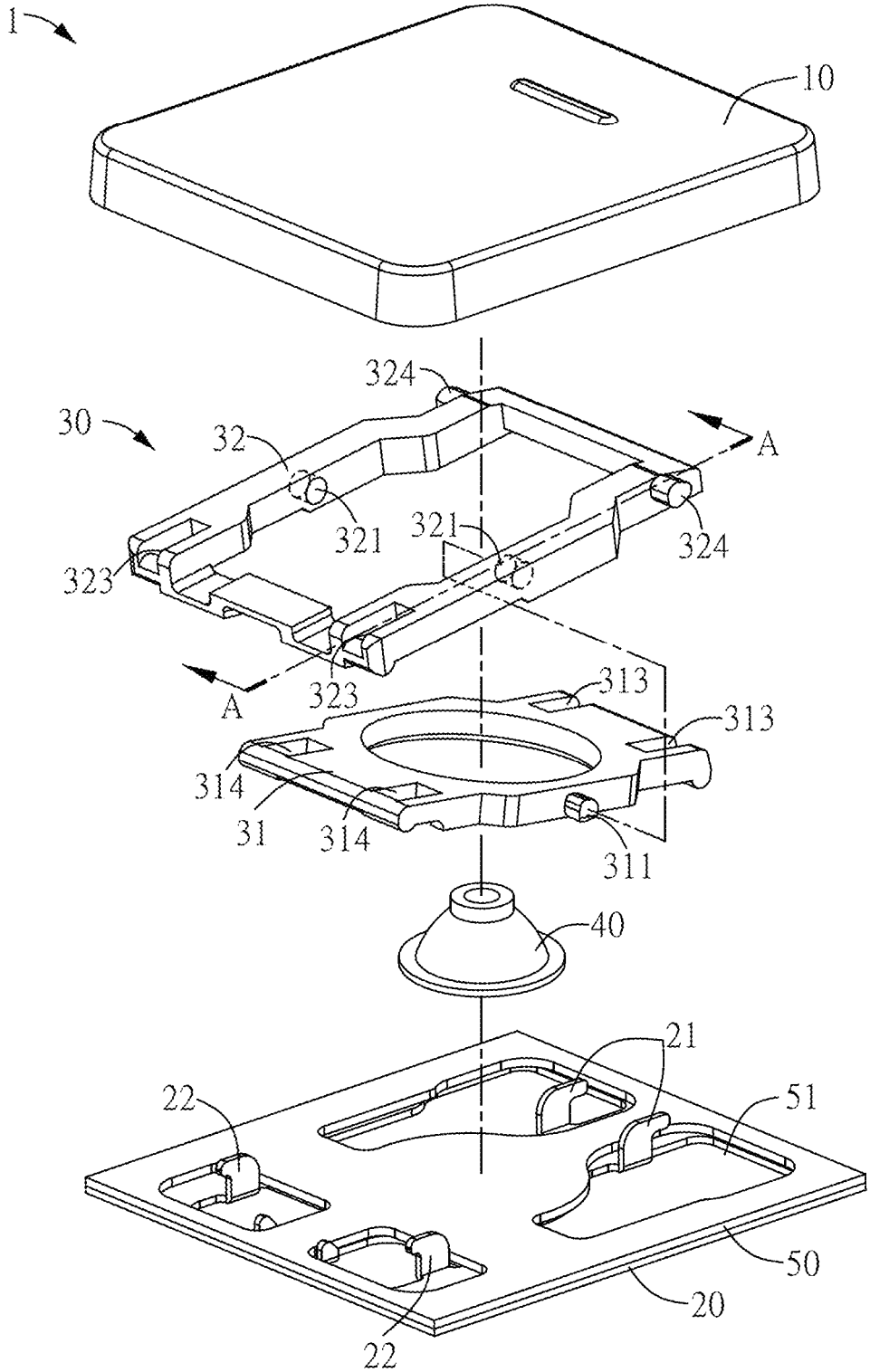
FIG. 3 illustrates an exploded view of the key structure shown in FIG. 2.

Please refer to FIG. 2 and FIG. 3, wherein FIG. 2 illustrates a schematic view of a key structure according to an embodiment of the present disclosure and FIG. 3 illustrates an exploded view of the key structure shown in FIG. 2. In this embodiment, the key structure 1 comprises a keycap 10, a base plate 20, a scissor-type connecting assembly 30, an elastic member 40 and a circuit board 50. The base plate 20 comprises a first hook 21 and a second hook 22, and the circuit board 50 has a plurality of openings 51 corresponding to the structure of the base plate 20. The circuit board 50 is disposed on a surface of the base plate 20, and the first hook 21 and second hook 22 are able to pass through the opening 51 and protrude from the circuit board 50. Further, the elastic member 40 is disposed between the keycap 10 and the circuit board 50. When the keycap 10 is pressed, the elastic member 40 triggers a switch of the circuit board 50 to generate an electronic signal and returns the keycap 10 to the original height (or position) of the keycap 10 before being pressed.

The scissor-type connecting assembly 30 connects to the base plate 20 and the keycap 10, and the keycap 10 is able to move up and down relative to the base plate 20. The scissor-type connecting assembly 30 comprises a first connecting member 31 and a second connecting member 32. In this embodiment, the first connecting member 31 is an inner connecting member, and the second connecting member 32 is an outer connecting member. In other words, the first connecting member 31 is located inside the second connecting member 32.

One endof the first connecting member 31 connects to the base plate 20, and the other end of the first connecting member 31 connects to the keycap 10. One end of the second connecting member 32 connects to the base plate 20, and the other end of the second connecting member 32 connects to the keycap 10. Further, the first connecting member 31 comprises at least one pivot 311, the second connecting member 32 comprises at least one pivot hole 321, and the pivot 311 is disposed in the pivot hole 321. In other words, the first connecting member 31 and the second connecting member 32 are connected to each other by the pivot 311 and the pivot hole 321 such that the keycap 10 can move up and down.

Figure 4:
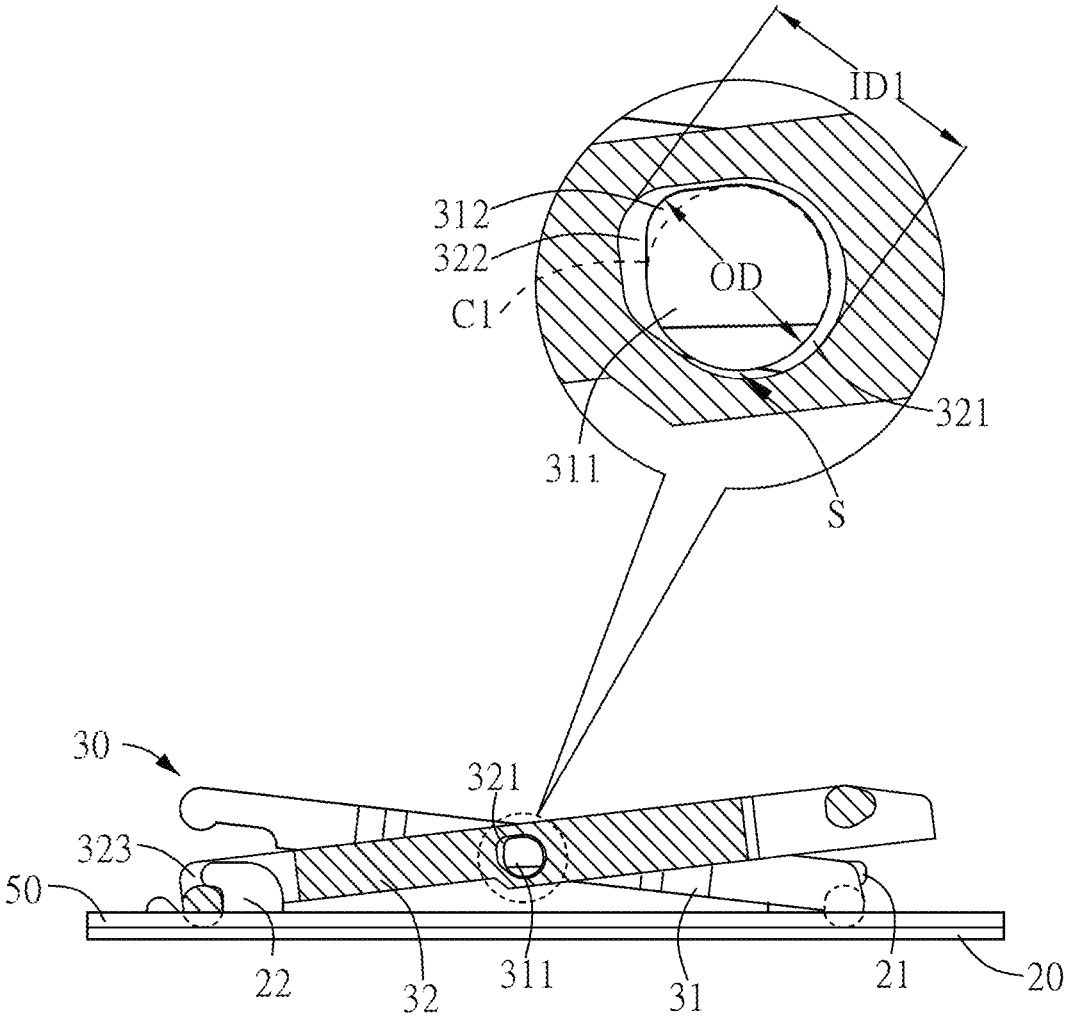
FIG. 4 illustrates a schematic view of the combination of a base plate, a scissor-type connecting assembly and a circuit board shown in FIG. 3.
Figure 5:
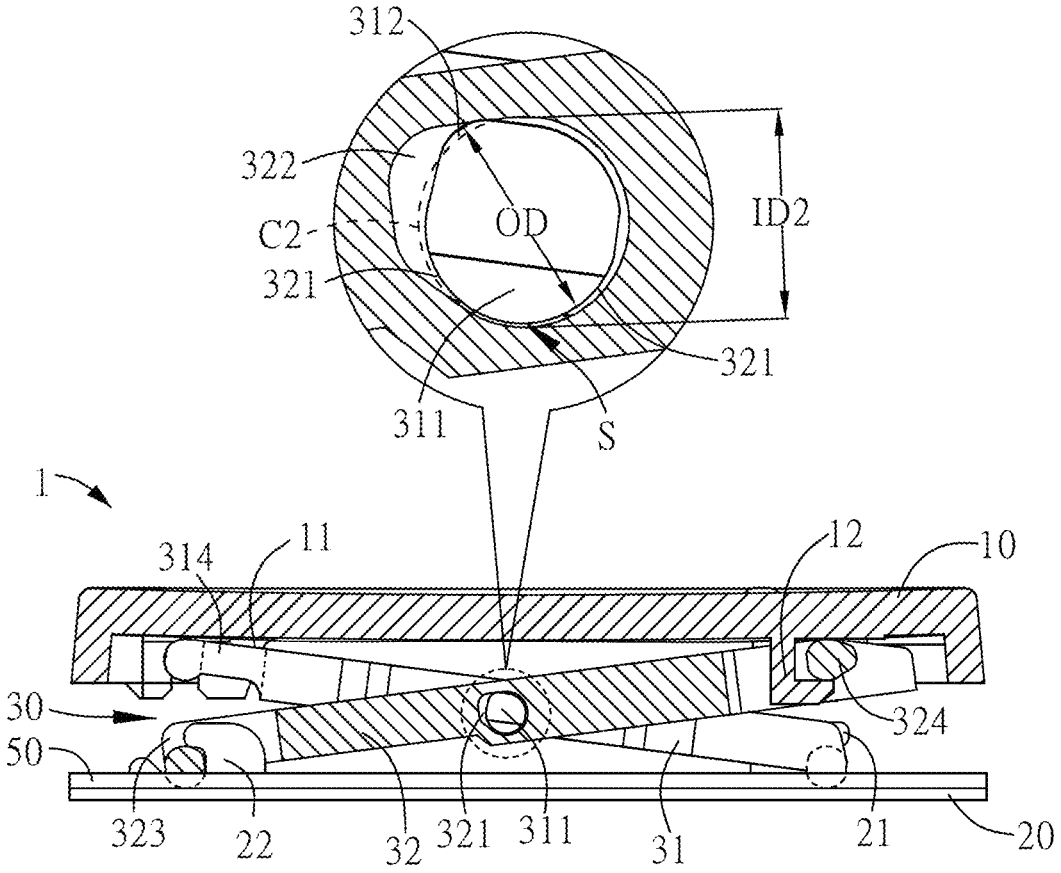
FIG. 5 illustrates a sectional view of the key structure shown in FIG. 2.

Please refer to FIG. 3 and FIG. 4. FIG. 4 illustrates a schematic view of the combination of a base plate, a scissor-type connecting assembly and a circuit board shown in FIG. 3, and FIG. 4 also illustrates a sectional view of the A-A line. In this embodiment, the pivot 311 has a convex portion 312, so the cross section of the pivot 311 is a non-circular and irregular shape, and FIG. 4 further indicates a circular portion C1 by a dotted line. The convex portion 312 extends outward from the circular portion C1 to form the pivot 311 such that its whole shape is a non-circular shape. In other words, the pivot 311 could be a camshaft. Further, the maximum inner diameter ID1 of the pivot hole 321 is greater than the maximum outer diameter OD of the pivot 311 such that the pivot 311 can be disposed in the pivot hole 321. FIG. 5 illustrates a sectional view of the key structure shown in FIG. 2. A space S between the pivot 311 and the pivot hole 321 can be reduced by the structure of the convex portion 312, as shown in FIG. 5, thereby to reduce shaking when the keycap is pressed. It should be noted that the space S herein refers to a space (or a gap) in the vertical direction, and that the smaller the space S is in the vertical direction, the less sway results when the keycap 10 is pressed.

Preferably, the pivot hole 321 of this embodiment has a recess 322 located on an inner wall of the pivot hole 321 such that the whole shape of the pivot hole 321 is non-circular and irregular, as shown in FIG. 5. FIG. 5 further indicates a circular portion C2 by a dotted line, and the recess 322 is a concave structure extending outward from the circular portion C2. The pivot hole 321 has the recess 322 to achieve the effect of facilitating assembly.

When the key structure 1 is assembled, the scissor-type connecting assembly 30 can be assembled first. In general, the pivot 311 of the first connecting member 31 is directly placed into the pivot hole 321 of the second connecting member 32. In this embodiment, the convex portion 312 of the pivot 311 is aligned with the recess 322 of the pivot hole 321, and then the pivot 311 can be easily assembled into the pivot hole 321, as shown in FIG. 4. In other words, a position of the maximum outer diameter OD of the pivot 311 is aligned with a position of the maximum inner diameter ID1 of the pivot hole 321 such that the pivot 311 can be assembled into the pivot hole 321 without interference.

Then one end of the scissor-type connecting assembly 30 is disposed in the base plate 20, and after that, the keycap 10 is disposed in the other end of the scissor-type connecting assembly 30. Please refer to FIG. 3 and FIG. 4; one end of the first connecting member 31 has a first connecting portion 313, and one end of the second connecting member 32 has a second connecting portion 323. The first connecting portion 313 is snapped into the first hook 21 of the base plate 20, and the second connecting portion 323 is snapped into the second hook 22, and thereby the scissor-type connecting assembly 30 is disposed in the base plate 20.

Further, the other end of the first connecting member 31 has a first pivot 314, and one end of the second connecting member 32 has a second pivot 324. The keycap 10 has a first hook portion 11 and a second hook portion 12, which are corresponded to the first pivot 314 and the second pivot 324 respectively, as shown in FIG. 5. Finally, the first hook portion 11 is snapped into the first pivot 314, and the second pivot 324 is fastened by the second hook portion 12, and thereby the keycap 10 is fully disposed in the scissor-type connecting assembly 30.

When the keycap 10 is disposed on the scissor-type connecting assembly 30, the keycap 10 and the scissor-type connecting assembly 30 are pressed downward. After the assembly of the keycap 10, the elastic member 40 offers an elastic force to return the keycap 10 back to an original position, as shown in FIG. 5. When the first connecting member 31 and the second connecting member 32 are assembled, the position of the convex portion 312 is corresponded to the recess 322. When the keycap 10 and the scissor-type connecting assembly 30 move to the original position, the convex portion 312 moves upward with the first connecting member 31, and the convex portion 312 presses against the inner wall of the pivot hole 321.

Taking FIG. 4 as an example, the convex portion 312 is located at the upper left side of the pivot 311, and the recess 322 is located at the upper left side of the pivot hole 321. When the keycap 10 and the scissor-type connecting assembly 30 move back to the original position, the first connecting member 31 moves in a clockwise direction with the first connecting portion 313 as a pivot point. At the same time, the convex portion 312 gradually shifts to the right (in a clockwise direction) with the first connecting member 31 until the convex portion 312 presses against the inner wall of the pivot hole 321. Preferably, a position of the convex portion 312 pressing against the pivot hole 321 is adjacent to the recess 322, as shown in FIG. 5, and the convex portion 312 presses against the right side of the recess 322.

Preferably, in this embodiment, a minimum inner diameter ID2 is smaller than or equal to the maximum outer diameter OD of the pivot 311. It should be noted that the minimum inner diameter ID2 is a diameter of the circular portion C2 indicated with the dotted line. Furthermore, when the keycap 10 is pressed to move downward, the space S in the vertical direction is reduced to almost no volume to prevent shaking when the keycap 10 is being pressed. When the scissor-type connecting assembly 30 of this embodiment is applied for the asymmetric scissor-type connecting member, then even if the heights of the first pivot 314 and the second pivot 324 are different, the upper surface of the keycap 10 can be at the same height without tilting.

As described above, according to the key structure of the present disclosure, the scissor-type connecting assembly includes a first connecting member and a second connecting member. The first connecting member includes at least one pivot having a convex portion. The second connecting member includes at least one pivot hole, and the pivot is disposed in the pivot hole. The space between the pivot and the pivot hole can be reduced by the structure of the convex portion such that shaking of the keycap can also be reduced when the keycap is pressed.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present disclosure without departing from the scope or spirit of the disclosure.

What is claimed is:

1. A key structure, comprising:

a keycap;

a base plate; and a scissor-type connecting assembly, comprising:

a first connecting member, one end of which is connected to the base plate and the other end of which is connected to the keycap, the first connecting member comprising at least one pivot having a convex portion, wherein the cross section of the pivot is a non-circular and irregular shape; and a second connecting member, one end of which is connected to the base plate and the other end of which is connected to the keycap, the second connecting member comprising at least one pivot hole, wherein the pivot hole is a closed hole, and the pivot is disposed in the pivot hole, wherein the pivot hole comprises a circular portion and a recess extending outward from the circular portion.

2. The key structure as claimed in claim 1, wherein a maximum inner diameter of the pivot hole is greater than a maximum outer diameter of the pivot.

3. The key structure as claimed in claim 1, wherein a minimum inner diameter of the pivot hole is smaller than or equal to a maximum outer diameter of the pivot.

4. The key structure as claimed in claim 1, wherein the recess is located on an inner wall of the pivot hole.

5. The key structure as claimed in claim 4, wherein the convex portion is corresponded to the recess, such that the pivot is disposed in the pivot hole.

6. The key structure as claimed in claim 4, wherein the convex portion presses against the inner wall of the pivot hole when the keycap is pressed down.

7. The key structure as claimed in claim 4, wherein a position of the convex portion pressing against the pivot hole is adjacent to the recess.

8. The key structure as claimed in claim 1, wherein the pivot of the first connecting member is a camshaft.

9. The key structure as claimed in claim 1, wherein the first connecting member is located inside the second connecting member.

* * * * *